US006708466B2

(12) United States Patent
Spatafora

(10) Patent No.: US 6,708,466 B2
(45) Date of Patent: Mar. 23, 2004

(54) METHOD OF PRODUCING SOFT PACKETS OF CIGARETTES

(75) Inventor: Mario Spatafora, Bologna (IT)

(73) Assignee: G.D Societa' Per Azioni, Bologna (IT)

( * ) Notice: Subject to any disclaimer, the term of this patent is extended or adjusted under 35 U.S.C. 154(b) by 0 days.

(21) Appl. No.: 10/145,254

(22) Filed: May 14, 2002

(65) Prior Publication Data

US 2002/0189208 A1 Dec. 19, 2002

(30) Foreign Application Priority Data

May 14, 2001 (IT) ..... BO2001A0298

(51) Int. Cl.[7] ..... B65B 11/10

(52) U.S. Cl. ..... 53/466; 53/415; 53/449; 53/491; 53/173; 53/228; 53/376.2

(58) Field of Search ..... 53/415, 466, 461, 53/449, 491, 173, 228, 229, 230, 231, 232, 233, 234, 376.2, 376.5, 377.5

(56) References Cited

U.S. PATENT DOCUMENTS

| | | | | | |
|---|---|---|---|---|---|
| 4,838,846 | A | * | 6/1989 | Focke et al. | 493/132 |
| 5,010,929 | A | | 4/1991 | Tisma | |
| 5,461,841 | A | * | 10/1995 | Spada et al. | 53/234 |
| 5,701,725 | A | * | 12/1997 | Neri et al. | 53/466 |
| 5,806,279 | A | * | 9/1998 | Spatafora | 53/399 |
| 5,822,948 | A | * | 10/1998 | Manservigi et al. | 52/466 |
| 5,839,253 | A | * | 11/1998 | Draghetti | 53/234 |
| 5,946,890 | A | * | 9/1999 | Focke et al. | 53/466 |
| 5,996,309 | A | * | 12/1999 | Focke et al. | 53/228 |
| 5,996,318 | A | * | 12/1999 | Draghetti | 53/466 |
| 6,000,199 | A | * | 12/1999 | Boldrini | 53/466 |
| 6,047,529 | A | * | 4/2000 | Draghetti | 53/466 |
| 6,105,340 | A | * | 8/2000 | Draghetti | 53/415 |
| 6,286,291 | B1 | * | 9/2001 | Tale' et al. | 53/456 |
| 6,324,817 | B1 | * | 12/2001 | Ghini et al. | 53/466 |
| 6,470,651 | B1 | * | 10/2002 | Polazzi et al. | 53/466 |
| 6,557,321 | B1 | * | 5/2003 | Coveney | 53/176 |

FOREIGN PATENT DOCUMENTS

| | | |
|---|---|---|
| EP | 0 330 495 | 8/1989 |
| EP | 0 712 783 | 5/1996 |
| EP | 0 756 996 | 2/1997 |
| EP | 0 865 987 | 9/1998 |
| EP | 0 972 704 | 1/2000 |
| EP | 1 022 220 | 7/2000 |
| EP | 1 052 171 | 11/2000 |

* cited by examiner

*Primary Examiner*—Stephen F. Gerrity
*Assistant Examiner*—Hemant M. Desai
(74) *Attorney, Agent, or Firm*—Marshall, Gerstein & Borun LLP

(57) ABSTRACT

A method of producing soft packets of cigarettes, whereby an inner packet, as it is fed along a packing path, is mated with a sheet of packing material withdrawn in a direction tangential with respect to the packing path. The sheet of packing material being folded into a U about the inner packet, so that a first end portion of the sheet of packing material contacts a minor lateral surface of the inner packet, and being further folded to form a tubular package which is subsequently closed at the end. The tubular package being closed laterally by detaching the first end portion from the relative minor lateral face, and inserting, beneath the first end portion, a second portion, an outer surface of which has been gummed beforehand.

26 Claims, 10 Drawing Sheets

METHOD OF PRODUCING SOFT PACKETS OF CIGARETTES

The present invention relates to a method of producing soft packets of cigarettes.

More specifically, the present invention relates to a method of producing soft packets of cigarettes comprising a substantially rectangular-prism-shaped inner packet, and a cup-shaped outer package formed by folding a sheet of packing material about the relative inner packet.

BACKGROUND OF THE INVENTION

According to known methods of producing soft packets of cigarettes (for example as disclosed in EP 1052171), a group of cigarette is fed in a pocket of an endless conveyor along a packing path, and through a supply station for supplying a relative sheet of packing material. The sheet of packing material is removed from the supply station by a gripper, which moves with the pocket, tangentially with respect to said packing path and is then fed along the packing path together with the group of cigarettes.

SUMMARY OF THE INVENTION

It is an object of the present invention to improve packing methods of producing soft packets, by increasing the speed and precision with which the packing procedures are performed, and by minimizing and, at the same time, simplifying the devices required to perform the packing procedures.

According to the present invention, there is provided a method of producing soft packets of cigarettes comprising a substantially rectangular-prism-shaped inner packet, and a cup-shaped outer package formed by folding a sheet of packing material about the relative inner packet; said inner packet being fed continuously along a packing path extending through a supply station for supplying a relative said sheet of packing material; said sheet of packing material being removed from said supply station tangentially with respect to said packing path, and then being fed along said packing path in a given feed direction together with said inner packet; said inner packet being fed through said supply station inside a relative first conveying pocket; said sheet of packing material being removed from said supply station by feeding gripping means continuously through the supply station, along at least a portion of said packing path, together with said first conveying pocket, in said feed direction; the method being characterized by imparting a reverse movement to said gripping means to substantially arrest the gripping means at said supply station in such a position as to interfere with said sheet of packing material being fed to said supply station; closing said gripping means on to said sheet of packing material; and arresting said reverse movement.

In the method defined above, said sheet of packing material is preferably fed to said supply station in a transverse direction crosswise to said packing path and to said feed direction.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
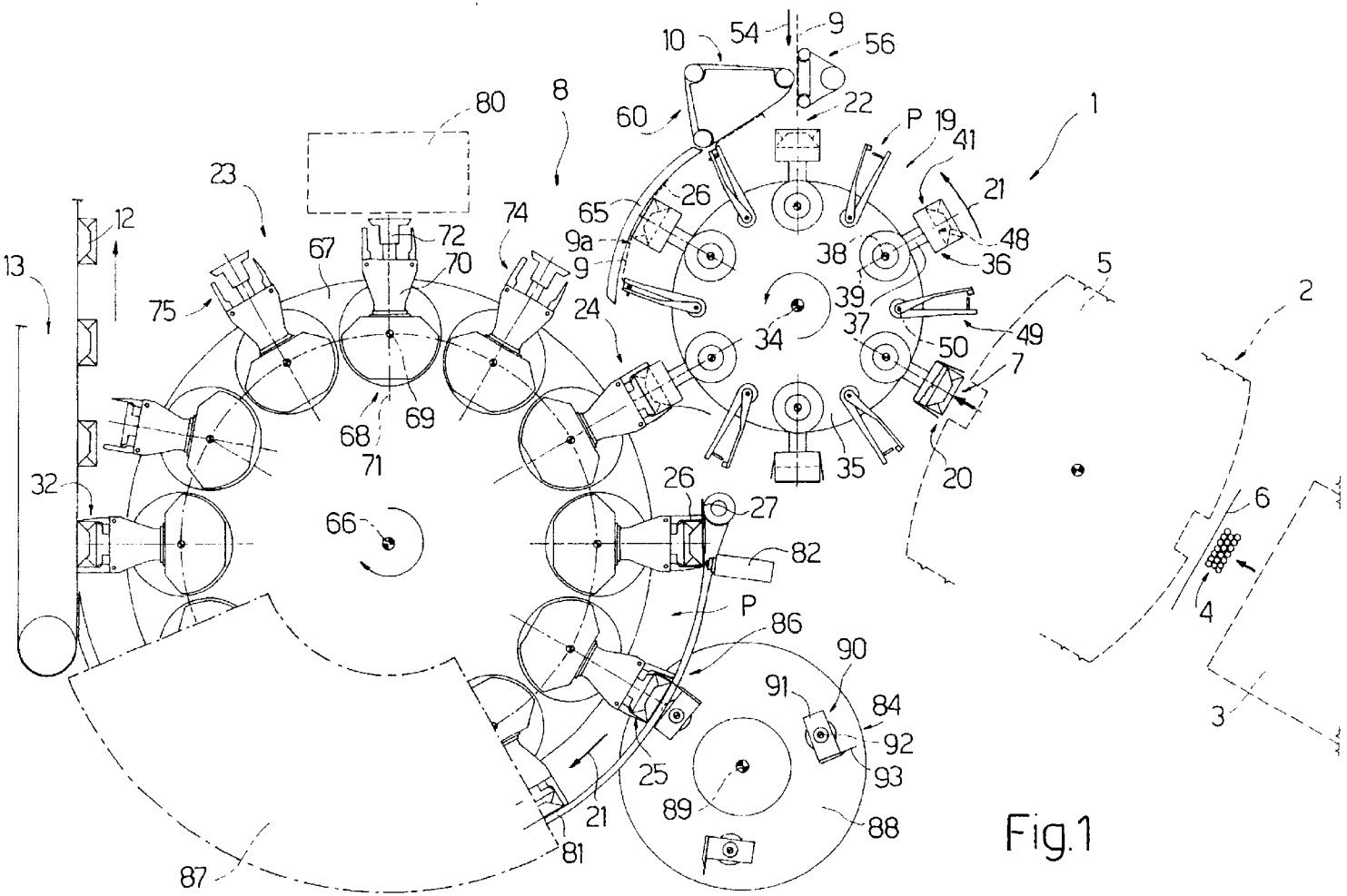
FIG. 1 shows a schematic side view, with parts in block form and parts removed for clarity, of a preferred embodiment of a packing machine for producing soft packets and implementing the method according to the present invention.

Number 1 in FIG. 1 indicates as a whole a packing machine for producing soft packets, and comprising a known input unit 2 substantially identical with corresponding units used on packing machines for producing rigid hinged-lid packets.

Input unit 2 comprises a module 3 for forming groups 4 of cigarettes; a packing module 5 for receiving a succession of groups 4 and relative sheets 6 of packing material, normally foil, from module 3, and for supplying at the output a succession of inner packets 7, each defined by a relative group 4 enclosed in a relative foil package formed by folding relative sheet 6 of packing material; and a further packing module 8 for receiving successive inner packets 7 from packing module 5 and relative sheets 9 of packing material, normally paper, from a supply unit 10, for folding sheets 9 of packing material about relative inner packets 7 to form, with each sheet 9 of packing material, a cup-shaped outer package 11 of a respective finished soft packet 12, and for feeding packets 12 successively to an output conveyor 13.

Each inner packet 7 is in the form of a substantially rectangular prism, comprises a longitudinal axis 14, two major lateral surfaces 15 parallel to each other and to longitudinal axis 14, two minor lateral surfaces 16 parallel to each other and to longitudinal axis 14 and perpendicular to major lateral surfaces 15, and two end surfaces 17 and 18 parallel to each other and perpendicular to longitudinal axis 14, and leaves input unit 2 in a direction crosswise to its longitudinal axis (perpendicular to the FIG. 1 plane) and with a major lateral surface 15 facing forwards.

Packing module 8 comprises a transfer conveyor defined by a transfer wheel 19, which is substantially tangent to the output of input unit 2 at a transfer station 20 and provides for receiving inner packets 7 successively from input unit 2, and for feeding inner packets 7 continuously in a direction 21 along a first portion of a packing path P and through a supply station 22 where each inner packet 7 is associated with a respective sheet 9 of packing material.

Packing module 8 also comprises a folding conveyor defined by a folding wheel 23 for receiving inner packets 7 and relative sheets 9 of packing material at a transfer station 24 located along packing path P and downstream from supply station 22 in direction 21, and for feeding them, still in direction 21, along a further portion of packing path P to form a relative outer package 11 about each inner packet 7 and so form relative packet 12.

On folding wheel 23, each packet 12 is formed by first forming, about relative inner packet 7, a tubular package 25 coaxial with longitudinal axis 14 of relative inner packet 7 and having a minor lateral wall defined by two superimposed, gummed end portions 26 and 27 of relative sheet 9 of packing material, and an axial tubular appendix 28 defined by a respective lateral portion 29 of relative sheet 9 of packing material projecting axially from end surface 18 of relative inner packet 7. Tubular appendix 28 comprises two major walls 30 substantially coplanar with relative major lateral surfaces 15 of relative inner packet 7; and two minor lateral walls 31 substantially coplanar with relative minor lateral surfaces 16 of relative inner packet 7.

Once tubular package 25 is formed, outer package 11 is completed by closing the end of tubular package 25 by folding relative tubular appendix 28 on to relative end surface 18, and the packets 12 leaving packing module 8 are transferred successively to output conveyor 13 at a transfer station 32.

Figure 2:
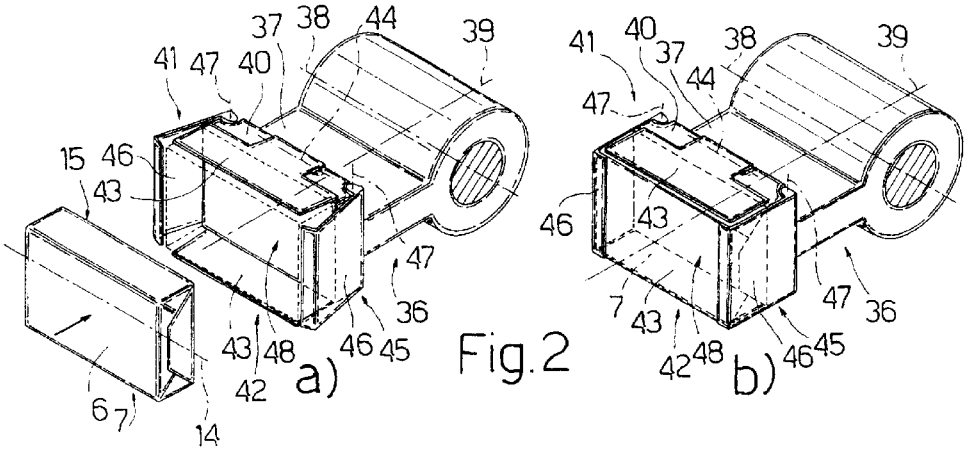
FIG. 2 shows a larger-scale view of a first FIG. 1 detail at two distinct operating steps.
Figure 3:
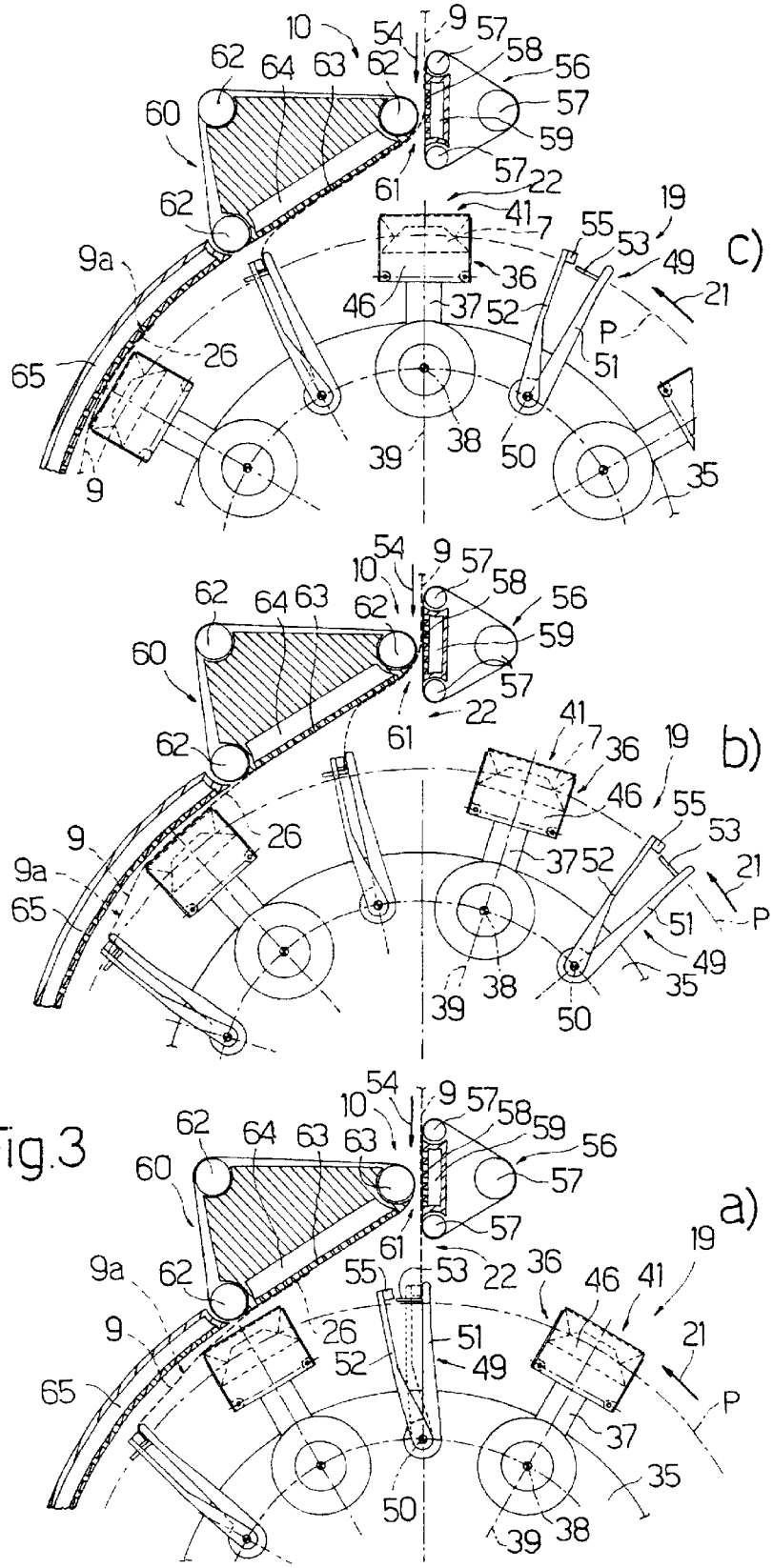
FIG. 3 shows a larger-scale, partly sectioned view of a second FIG. 1 detail at three distinct operating steps.

As shown in FIGS. 1 and 3, transfer wheel 19 is fitted to a front wall of a frame 33 (FIG. 7) in a position substantially tangent to the output of packing module 5, rotates continuously anticlockwise, in FIG. 1, about an axis 34 crosswise to feed direction 21, and comprises a powered disk 35 coaxial with and rotating about axis 34, and a number of gripping heads 36 equally spaced about axis 34 and each comprising an arm 37 fitted to disk 35 to oscillate, with respect to disk 35 and under the control of a known cam device (not shown), about a respective axis 38 parallel to axis 34. As shown more clearly in FIG. 2, each arm 37 extends along an axis 39 radial with respect to relative axis 38, and is fitted on the free end with a substantially rectangular plate 40 perpendicular to respective axis 39 and for supporting a relative inner packet 7 positioned with its longitudinal axis 14 perpendicular to the FIG. 1 plane, and with a major lateral surface 15 contacting plate 40.

Plate 40 defines the base of a respective conveying pocket 41 which, in addition to plate 40, also comprises a lateral gripper 42 defined by two flat jaws 43 projecting outwards from plate 40 and connected to respective opposite lateral edges of plate 40 to oscillate, about respective axes 44 parallel to relative axis 38, between a closed position (FIG. 2*b*) wherein jaws 43 are substantially perpendicular to relative plate 40, and an open position (FIG. 2*a*) wherein jaws 43 diverge outwards. Each pocket 41 also comprises a further lateral gripper 45 defined by two substantially L-shaped jaws 46 projecting outwards from plate 40 and connected to respective opposite lateral edges of plate 40 to oscillate, about respective axes 47 crosswise to relative axis 38, between a closed position (FIG. 2*b*) wherein jaws 46 are substantially perpendicular to relative plate 40, and an open position (FIG. 2*a*) wherein jaws 46 diverge outwards. When all in the closed position, jaws 43 and 46 define, together with relative plate 40, a prismatic seat 48 for receiving and radially retaining, by means of jaws 46, a relative inner packet 7.

As shown in FIGS. 1 and 3, transfer wheel 19 comprises a further number of gripping heads or grippers 49, each of which is interposed between a pair of adjacent gripping heads 36 and is associated functionally with the gripping head 36 immediately upstream in feed direction 21. Each gripper 49 oscillates, with respect to disk 35 and under the control of a known cam device (not shown), about a respective axis 50 parallel to axis 34, and comprises two jaws 51 and 52 hinged to disk 35 to oscillate, with respect to each other about relative axis 50 and under the control of a known cam device (not shown), between an open and a closed position. More specifically, jaw 51, upstream from jaw 52 in feed direction 21, has an intermediate transverse plate 53 extending towards relative jaw 52 and defining a stop for the front edge of a respective sheet 9 of packing material fed by supply unit 10 to supply station 22 in a direction 54 substantially radial with respect to disk 35 and crosswise to packing path P at supply station 22. Jaw 52, on the other hand, is fitted on the free end with a pad 55 which cooperates with an end portion of relative jaw 51 to grip a front portion of a respective sheet 9 of packing material positioned with its front edge on relative plate 53.

As shown more clearly in FIG. 3, supply unit 10 comprises a powered conveyor 56 looped about pulleys 57 and having a work branch 58 extending in direction 54 and contacting a suction box 59; and a further powered conveyor 60 defining, with conveyor 56, an outlet 61 of supply unit 10, and located downstream from conveyor 56 in feed direction 21. Conveyor 60 is looped about pulleys 62 and has a work branch 63 extending along packing path P, substantially in feed direction 21, and contacting a suction box 64 immediately upstream from a fixed suction plate 65 extending about axis 34 between supply station 22 and transfer station 24.

In actual use, each gripping head 36 and relative gripper 49 are fed continuously, both in the open position, to transfer station 20 where gripping head 36, oscillating in known manner about relative axis 38, receives a relative inner packet 7 inside seat 48 of respective pocket 41 and retains it by moving relative grippers 42 and 45 into the closed position.

The closed gripping head 36 and the open gripper 49 are then fed (FIG. 3*a*) by disk 35 towards supply station 22, which is reached first by gripper 49 and then by relative gripping head 36.

Close to supply station 22, gripper 49 is oscillated about relative axis 50 to rotate first in the same direction as and then in the opposite direction to disk 35, which opposite rotation is tantamount to reversing and temporarily arresting the free end of gripper 49 in a position facing outlet 61 of supply unit 10, and relative plate 53 in a position crosswise to direction 54 to intercept the front edge of a sheet 9 of packing material fed through outlet 61 by supply unit 10 and in time with the arrival of gripper 49 at supply station 22. As the front edge of sheet 9 of packing material contacts plate 53, jaws 51 and 52 are moved into the closed position so that pad 55 clamps a front portion of sheet 9 of packing material against the portion of jaw 51 projecting beyond plate 53. At this point, the reverse movement of gripper 49 is arrested to enable gripper 49 to leave supply station 22, taking with it relative sheet 9 of packing material which is removed from outlet 61 in direction 21, i.e. in a tangential direction with respect to packing path P.

In connection with the above, it should be stressed that removing sheet 9 of packing material in a tangential direction with respect to packing path P and the possibility of regulating the speed of relative gripper 49 in direction 21 enable gripper 49 to grip sheet 9 of packing material extremely accurately and so position it in an extremely precise given position—described later on—with respect to relative inner packet 7.

As it is fed towards transfer station 24, sheet 9, the front portion of which is retained firmly by relative gripper 49, trails behind gripper 49 with an outer surface 9*a* contacting an inner suction surface of plate 65, and is smoothed out (FIG. 3*b*) by the pneumatic braking action of plate 65 so that an intermediate portion contacts the outer major lateral surface 15 of relative inner packet 7 carried by the adjacent upstream gripping head 36. More specifically, the sheet is positioned, with respect to relative inner packet 7, so that end portion 26 projects rearwards of the rear minor lateral surface 16 of inner packet 7.

Folding wheel 23 is fitted to frame 33 (FIG. 7) in a position substantially tangent to transfer wheel 19, rotates continuously clockwise in FIG. 1 about an axis 66 parallel to axis 34, and comprises a powered disk 67 coaxial with and rotating about axis 66, and a number of gripping heads 68 equally spaced about axis 66 and fitted to disk 67 to oscillate, with respect to disk 67 and under the control of known cam device (not shown), about respective axes 69 parallel to axis 66.

Figure 4:
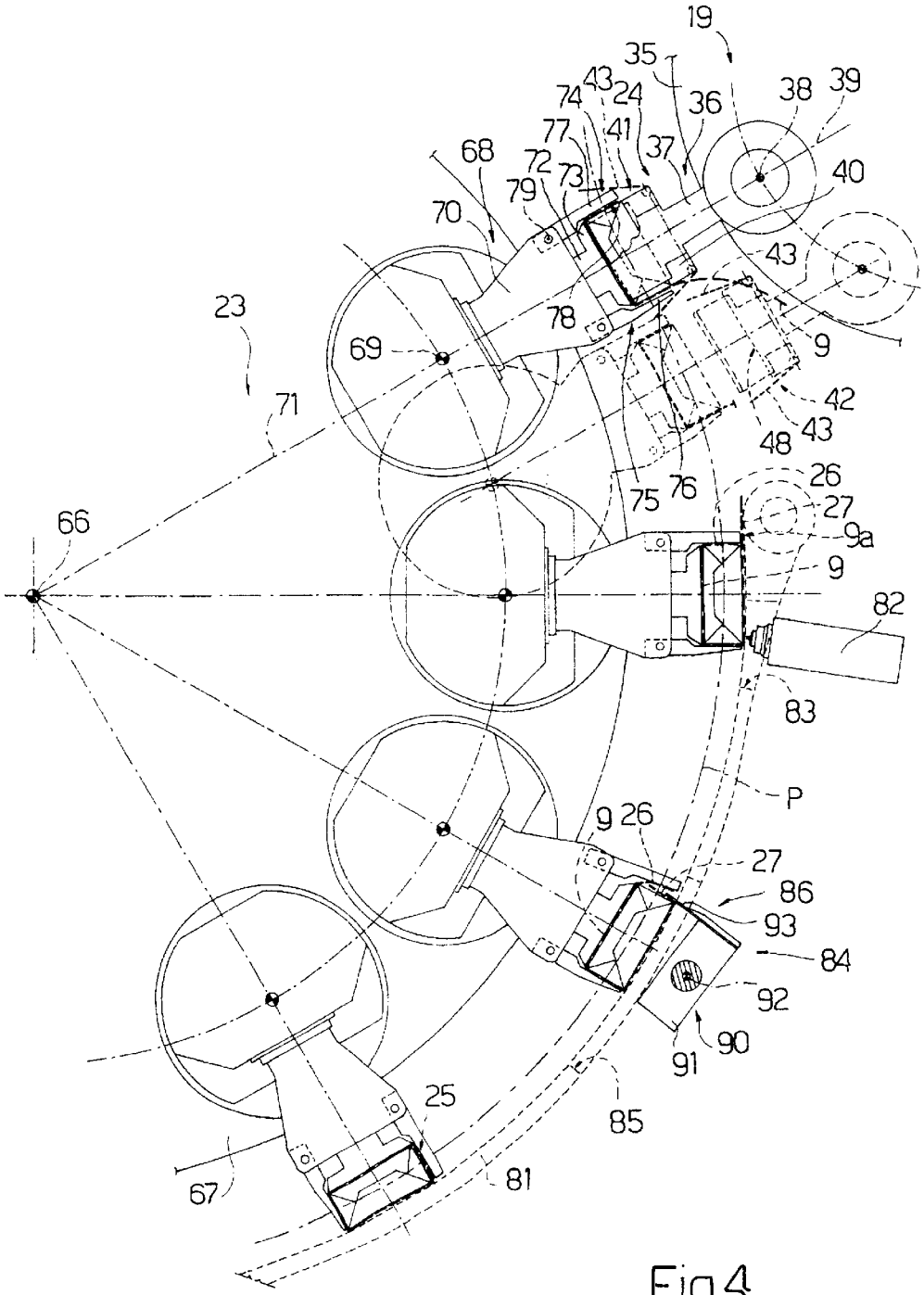
FIG. 4 shows a larger-scale view, with parts removed for clarity, of a third FIG. 1 detail.
Figure 5:
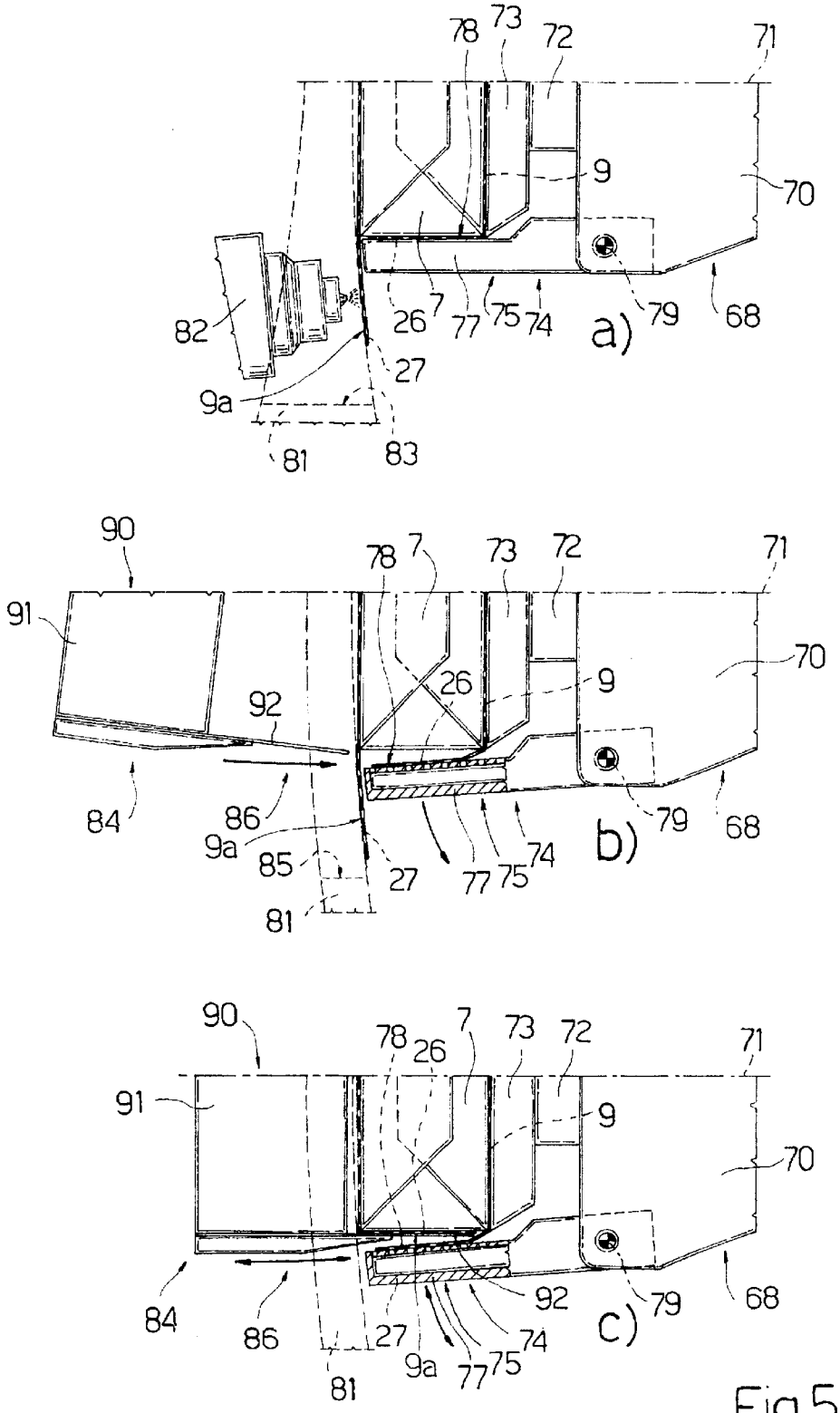
FIG. 5 shows a larger-scale, partly sectioned view of a FIG. 4 detail at three distinct operating steps.

As shown more clearly in FIGS. 4 and 5, each gripping head 68 comprises an arm 70 hinged to disk 67 to oscillate about respective axis 69 and extending along an axis 71 radial with respect to relative axis 69; and a pusher 72 moved inside relative arm 70 by a known cam device (not shown) and coaxial with relative axis 71. Each pusher 72 comprises a head 73 defined externally by a suction surface in turn defining a movable base of a respective pocket 74 for housing a respective sheet 9 of packing material and relative inner packet 7 positioned with its longitudinal axis 14 parallel to relative axis 69, and with a major lateral surface 15 facing relative head 73.

In addition to head 73, each pocket 74 also comprises a lateral gripper 75 defined by two flat jaws 76 and 77 projecting outwards from respective arm 70 and on opposite sides of relative head 73 in feed direction 21. In each gripper 75, the front jaw 76 is parallel to relative axis 71 and fixed; while jaw 77 (FIG. 5) has an inner suction surface 78 and is connected to relative arm 70 to oscillate, with respect to arm 70 and about a respective axis 79 parallel to relative axis 69, between an open position wherein jaw 77 diverges outwards with respect to relative jaw 76, and a closed position parallel to relative jaw 76.

As shown in FIG. 1, folding wheel 23 is associated with a known device 80 for supplying revenue stamps (not shown) and located outwards of folding wheel 23 and upstream from transfer station 24; a fixed guide plate 81 extending, coaxially with axis 66, between transfer stations 24 and 32; a gumming device 82 located along plate 81 and outwards of wheel 23, and operating through an opening 83 (FIG. 4) formed in plate 81 to feed glue on to the outer surface 9*a* of end portion 27 of each sheet 9 of packing material; a folding device 84 located along plate 81 and outwards of folding wheel 23, and operating through an opening 85 (FIG. 4) formed through plate 81 at a folding station 86 to complete the folding of each sheet 9 of packing material about relative inner packet 7 and so form relative tubular package 25; and a known further folding device 87 supported by plate 81, between folding station 86 and transfer station 32, to close the ends of tubular packages 25 in known manner, and correctly fold the relative revenue stamps (not shown).

Folding device 84 comprises a powered wheel 88 mounted to rotate continuously anticlockwise, in FIG. 1, about an axis 89 parallel to axis 34; and a number of folding heads 90 fitted to wheel 88 and equally spaced about axis 89. Each folding head 90 comprises a crank 91 fitted to wheel 88 to oscillate with respect to wheel 88 about a respective axis 92 parallel to axis 89; and a folding blade 93 connected integrally to one end of relative crank 91, crosswise to relative crank 91, and projecting outwards, with respect to crank 91, in a substantially radial direction with respect to wheel 88.

Figure 6:
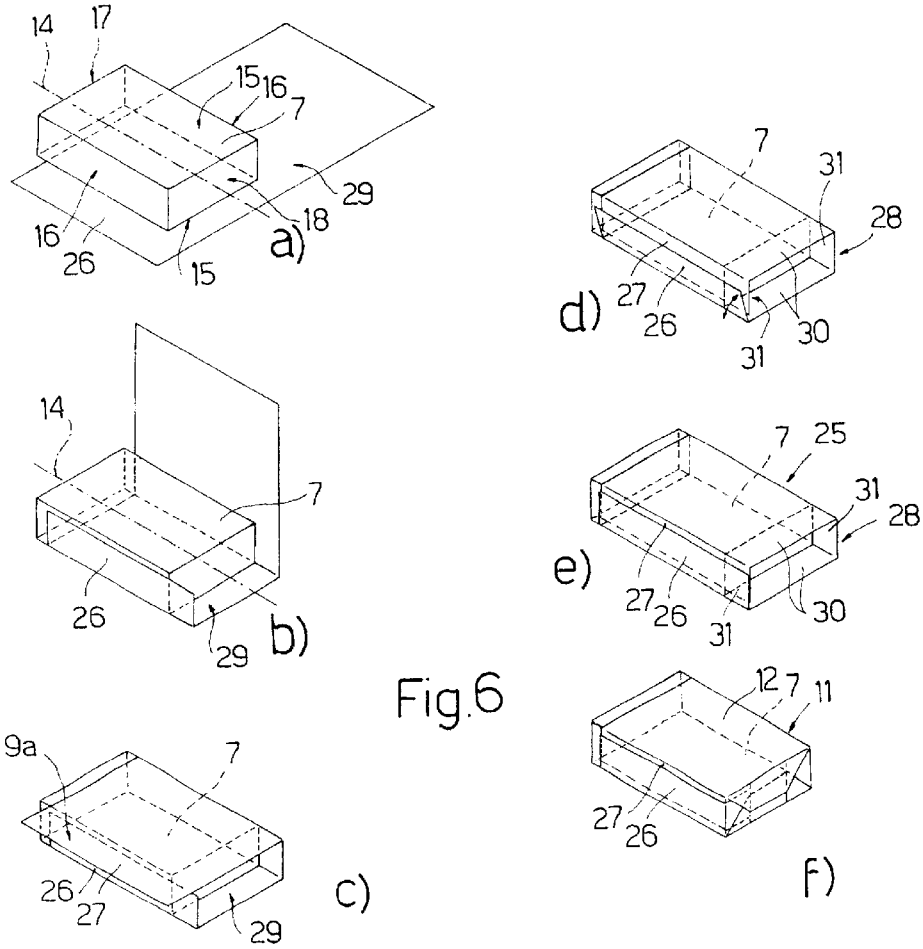
FIG. 6 shows, in perspective, a folding sequence of an outer sheet of packing material.

In actual use, and as shown in FIG. 4, each gripping head 36, on approaching transfer station 24, oscillates about relative axis 38 to keep axis 39 aligned, for a given period of time, with axis 71 of a corresponding gripping head 68, which is oscillated accordingly on disk 67 and fed by folding wheel 23 to transfer station 24 in time with said gripping head 36. Each head 36, as it oscillates about respective axis 38, is accompanied by relative gripper 49, so as to hold relative sheet 9 on relative inner packet 7 in the position described previously (FIG. 6*a*), i.e. with relative end portion 26 projecting rearwards of rear minor lateral surface 16 of inner packet 7.

Gripping head 68 reaches transfer station 24 with jaw 77 open, and with pusher 72—the head 73 of which has already received and retains the relative revenue stamp (not shown) by suction—in the extracted position; and gripping head 36 reaches transfer station 24 with gripper 42 open and gripper 45 closed, so as to retain relative inner packet 7 and enable inner packet 7 to penetrate pocket 74 of gripping head 68, which is eased down by gradually withdrawing pusher 72.

As inner packet 7 is inserted inside pocket 74, relative sheet 9 of packing material is folded into a U (FIG. 6*b*) with end portion 26 between jaw 77 and the minor lateral surface 16 of inner packet 7 located rearwards in feed direction 21; with an intermediate portion between head 73 and the inner major lateral surface 15 of inner packet 7; with a further intermediate portion between jaw 76 and the minor lateral surface 16 of inner packet 7 located frontwards in feed direction 21; with an end portion projecting outwards of pocket 74 in a substantially radial direction; and with lateral portion 29 projecting axially (with respect to axis 66) from pocket 74.

At this point, gripper 75 is closed and the corresponding gripper 45 opened to permit removal of inner packet 7 and relative sheet 9 of packing material by gripping head 68, which is fed continuously towards plate 81, which folds said projecting end portion of sheet 9 of packing material (FIG. 6*c*) on to the outer major lateral surface 15 of relative inner packet 7, so that end portion 27 projects rearwards of rear minor lateral surface 16 of inner packet 7.

As gripping head 68 continues in feed direction 21, end portion 27 of relative sheet 9 of packing material is first fed (FIG. 5*a*) past opening 83, where gumming device 82 applies glue to outer surface 9*a*, and then past opening 85 (FIG. 5*b*) where jaw 77 is opened to raise end portion 26 retained by suction on jaw 77. A folding head 90, operating through opening 85 (FIG. 5*c*), then folds end portion 27 squarely (FIG. 6*d*) inside the gap between relative end portion 26 and the rear minor lateral surface 16 of relative inner packet 7. At this point, jaw 77 is closed to complete tubular package 25 (FIG. 6*e*), the tubular appendix 28 of which, projecting axially from relative pocket 74, is folded in known manner (FIG. 6*f*) on to end surface 18 of relative inner packet 7 as gripping head 68 travels through folding device 87, which completes packet 12, which is then transferred from folding wheel 23 to output conveyor 13 at transfer station 32.

In connection with the above, it should be stressed that the procedure for completing tubular package 25, and described above with reference to FIGS. 6*c–e*, provides for gumming end portion 27 not only just before being folded, but also from the outside, with obvious advantages as regards the structure and efficiency of machine 1 as a whole, and the precision and speed with which the folding procedure is performed.

Figure 7:
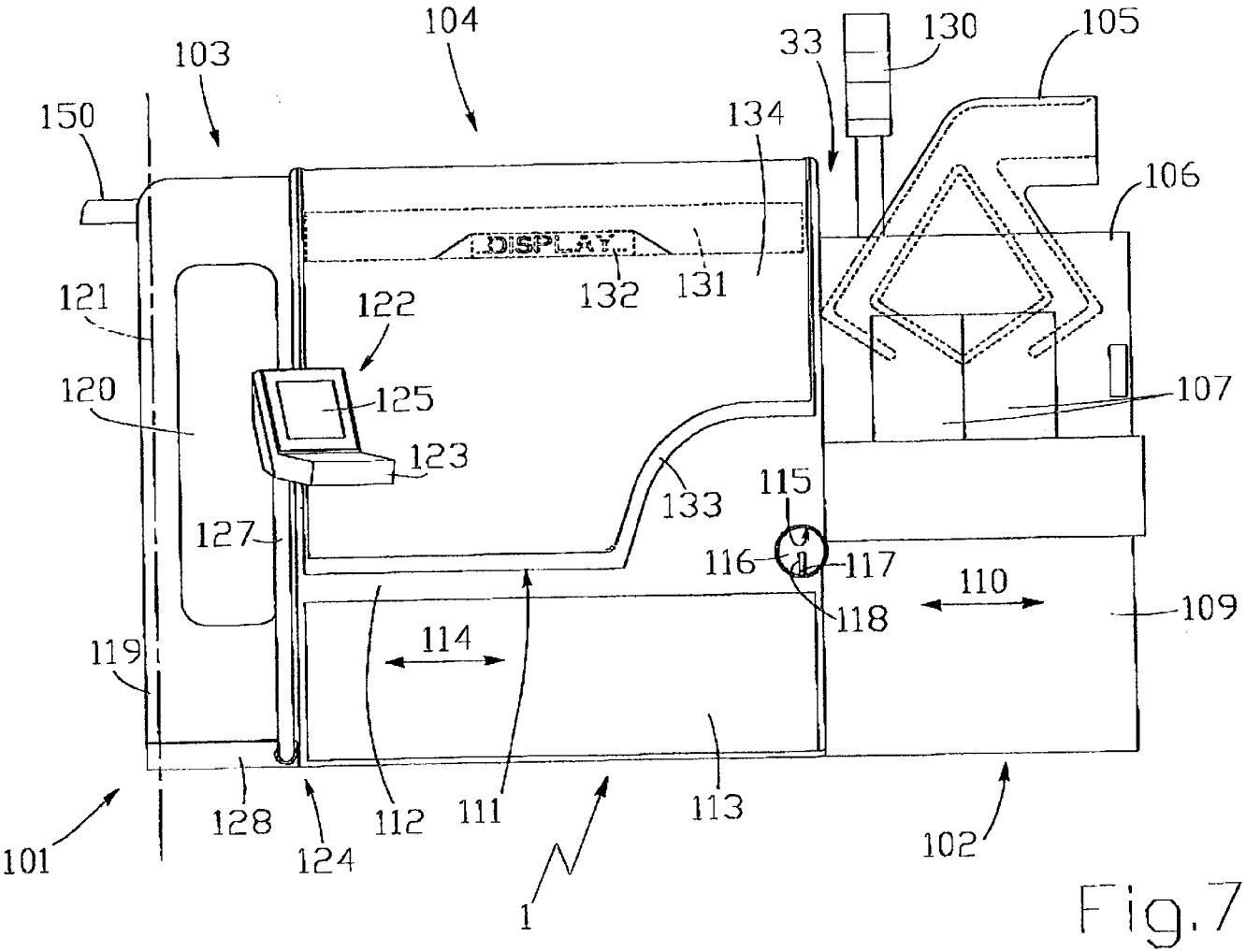
FIG. 7 shows a schematic front view of the FIG. 1 packing machine with a protective casing.

As shown in FIG. 7, packing machine 1 is provided with a protective casing 101 fitted to frame 33 and divided into two lateral sections 102 and 103 on opposite sides of a central section 104. Lateral section 102 of protective casing 101 protects group-forming module 3, which has a hopper 105 for supplying cigarettes (not shown); central section 104 of protective casing 101 protects packing module 5 and outer packing module 8; and lateral section 103 of protective casing 101 protects output conveyor 13.

Lateral section 102 of casing 101 comprises a top panel 106 fixed to frame 33 by screws (not shown) and having two see-through doors 107 for viewing and access to the bottom portion of hopper 105; an intermediate panel 108 fixed to frame 33 by screws (not shown) and covering group-forming module 3; and a bottom panel 109 fitted to frame 33 to slide, in a horizontal direction 110, between a closed position (shown in FIG. 7) and an open position (not shown).

Central section 104 of casing 101 comprises a see-through top panel 111 fitted to frame 33 to move between a closed position (shown in FIGS. 7 and 10) and an open position (shown in FIG. 11); an intermediate panel 112 fixed to frame 33 by screws (not shown); and a bottom panel 113 fitted to slide, in a horizontal direction 114, between a closed position (shown in FIG. 7) and an open position (not shown). Intermediate panel 112 has an opening 115 through which is inserted a handwheel 116 for operating packing machine 1 manually. Handwheel 116 has a grip 117, which is movable between a rest position (not shown) wherein grip 117 is housed inside a seat 118 formed in handwheel 116, and a work position (shown in FIG. 7) wherein grip 117 projects perpendicularly from handwheel 116.

Lateral section 103 of casing 101 comprises a door 119 which has a central window 120 protected by a see-through panel, and is hinged to rotate, about a vertical axis 121, between a closed position (shown in FIG. 7) and an open position (not shown).

Figure 8:
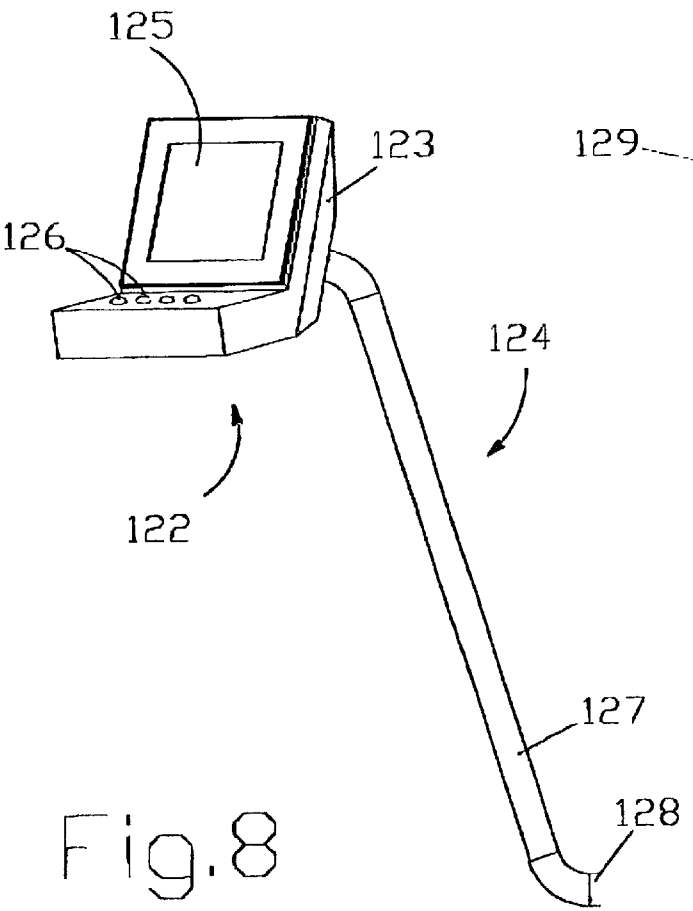

Packing machine 1 has a user interface (so-called HMI) unit 122 comprising a box-123 connected by a tubular body 124 to frame 33. Box 123 houses a monitor 125 for displaying information relating to the operation of packing machine 1 and preferably having touch-screen functions enabling the user to interact with user interface unit 122, and has a number of buttons 126 (shown in FIG. 8) for user control of the main functions of packing machine 1 (typically, stop, go, emergency stop, alarm acquisition, and operating speed adjustment).

Figure 9:
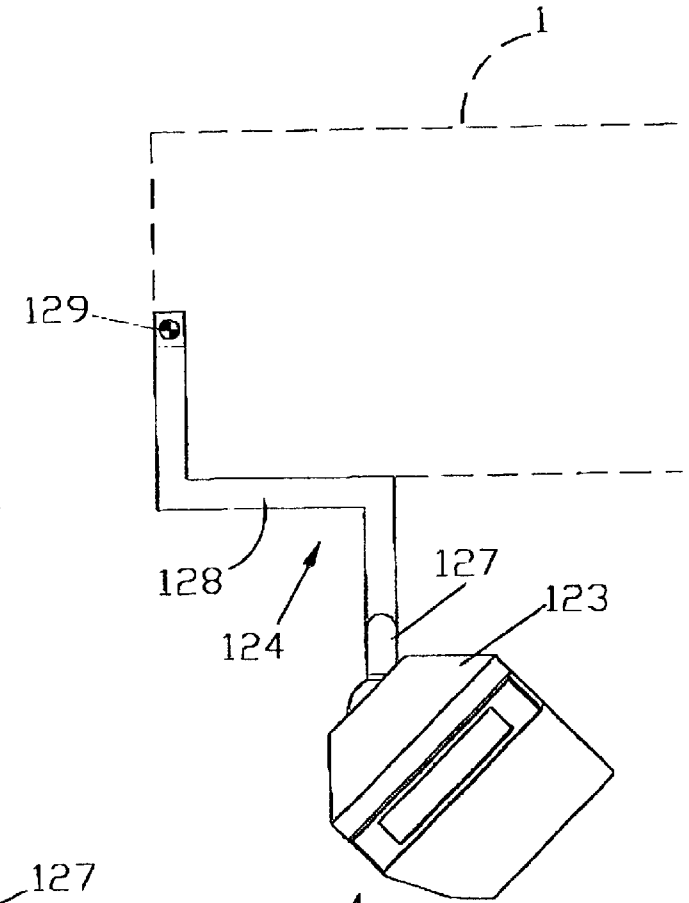
FIGS. 8 and 9 show two larger-scale views of a detail in FIG. 7.

Tubular body 124 houses the connecting cables of user interface unit 122, and comprises a vertically tilted portion 127 supporting box 123 at one end and connected at the other end to a horizontal portion 128 hinged to the base of frame 33 to rotate, about a vertical axis 129, between a work position (FIGS. 7, 8, 9) wherein box 123 is located in front of packing machine 1, and a rest position (not shown) wherein body 123 is located to the side of, to permit free access to, packing machine 1. Horizontal portion 128 is designed to position box 123 and vertical axis 129 a relatively long distance apart, so that, when rotated about axis 129, box 123 is swung well clear of packing machine 1. And, for compactness, horizontal portion 128 is designed to substantially contact the base of frame 33 when box 123 is in the work position.

As shown in FIG. 7, frame 33 supports a known multicolor lamp 130, i.e. having various sections of different colors; and a horizontal beam 131 housing a relatively large graphic display 132 preferably comprising a matrix of red LED's for displaying writing visible from a distance of at least 20 meters. Horizontal beam 131 is preferably located so as to be covered by the see-through top panel 111 of central section 104 of protective casing 101.

In actual use, multicolor lamp 130 shows a green light when packing machine 1 is operating normally; a red light when packing machine is idle; and a yellow light when packing machine 1 is operating but in the presence of an alarm requiring intervention on the part of the operator. When the yellow light of multicolor lamp 130 comes on, details of the type of intervention required are shown simultaneously on display 132, so that the operator, reading display 132 some distance from packing machine 1, can monitor operation and organize any intervention required without having to consult monitor 125 of user interface 122 on machine 1 itself. Display 132 may, obviously, also be used for displaying information when packing machine 1 is operating normally or idle, thus enabling the operator to monitor operation of packing machine 1 from a relatively long distance.

Figure 10:
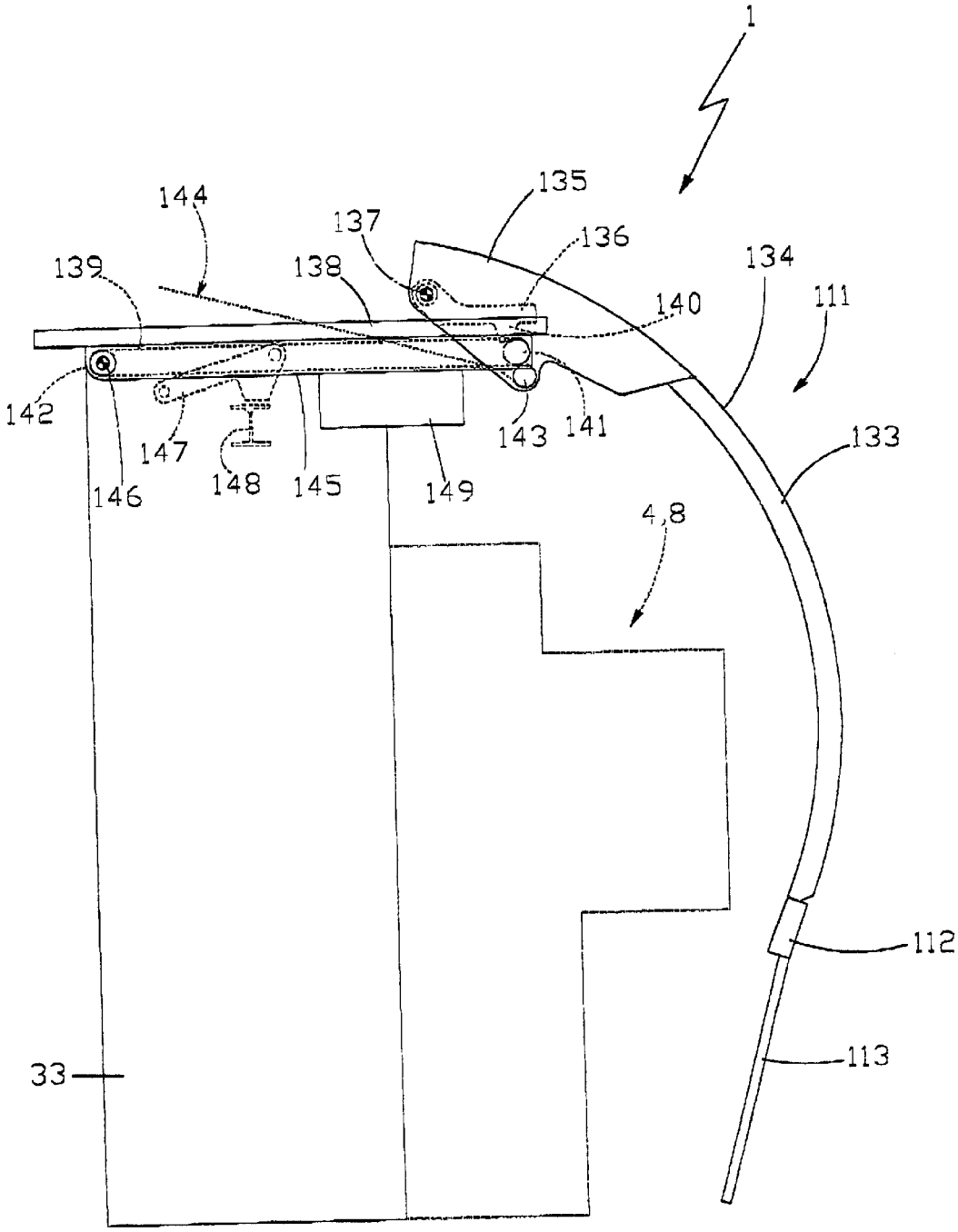
FIG. 10 shows a side section, with parts removed for clarity, of the FIG. 7 packing machine with a panel of the protective casing in the closed position.
Figure 11:
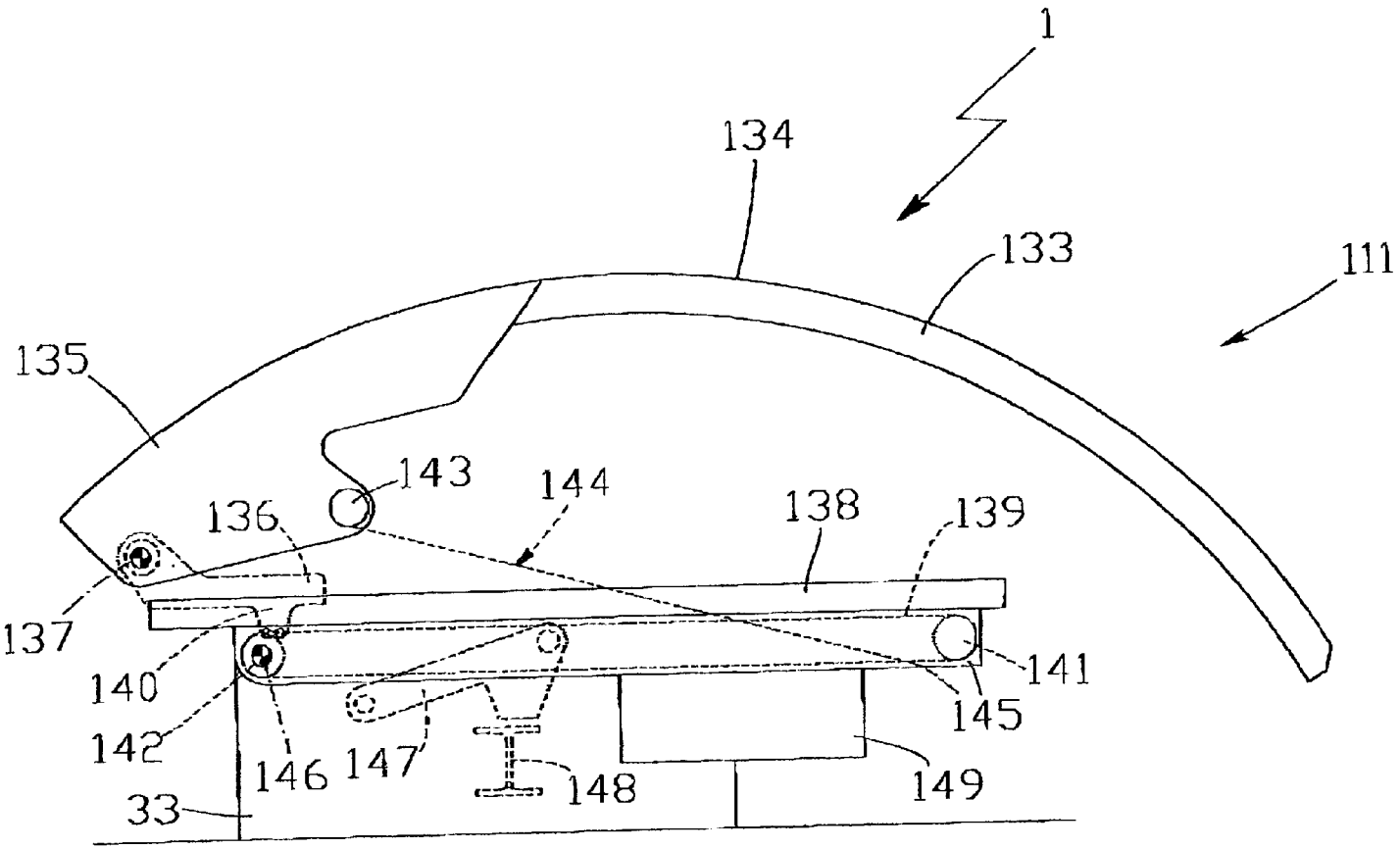
FIG. 11 shows a side section, with parts removed for clarity, of the FIG. 7 packing machine with a panel of the protective casing in the open position.

As shown in FIG. 10, top panel 111 comprises a rigid frame 133 supporting a see-through wall 134 and curved to prevent interference with packing module 5 and outer packing module 8 (shown schematically in FIG. 10). On opposite sides of panel 111, frame 133 is fitted with two plates 135 (only one shown in FIG. 10) supporting frame 133 and hinged to respective slides 136 (only one shown in FIG. 10) to swing freely about a horizontal axis 137. Each slide 136 is run along a respective horizontal guide 138 (only one shown in FIG. 10) by a corresponding horizontal chain 139 (only one shown in FIG. 10) connected to slide 136 by a relative connecting body 140. Each chain 139 is looped about a pair of end sprockets; an idle sprocket 141; and a sprocket 142 rotated by a reversible two-way motor (not shown). Each plate 135 is fitted with a tappet roller 143 mating with a corresponding fixed cam 144 (shown schematically in FIG. 10) substantially in the form of, an inclined surface.

In actual use, to move top panel 111 from the closed position (shown in FIGS. 7 and 10) to the open position (shown in FIG. 11), each sprocket 142 is rotated to move respective slide 136 along relative guide 138. As a result, plates 135 move towards the rear of packing machine 1 and, at the same time, are rotated about axis 137 by tappet rollers 143 rolling up along respective cams 144. The rotary and linear movement of plates 135 is also transferred to top panel 111 which, being connected to plates 135, is moved from the closed position (shown in FIGS. 7 and 10) to the open position (shown in FIG. 11). Obviously, to move top panel 111 from the open position (shown in FIG. 11) to the closed position (shown in FIGS. 7 and 10), the above operations are performed in reverse.

Guides 138, sprockets 141, 142 and, therefore, slides 136 and top panel 111 are supported by a beam 145 hinged to frame 33 to rotate, with respect to frame 33 and about a horizontal axis 146, between a closed position (shown in FIGS. 10 and 11) and an open position (not shown) under the control of an actuating device comprising an arm 147 hinged to frame 33 and beam 145 and which is raised by a known hydraulic lifting device (not shown).

Frame 33 is fitted with a horizontal guide 148, along which a known crane (not shown) runs freely. When beam 145 is in the closed position (shown in FIGS. 10 and 11), guide 148 is substantially concealed from the front of packing machine 1 by various operating devices 149 (shown schematically in FIGS. 10 and 11) supported by beam 145. Conversely, when beam 145 is in the open position (not shown), operating devices 149 are raised so that guide 148 is freely accessible from the front of packing machine 1. More specifically, the crane (not shown) can be set to an extracted position substantially crosswise to guide 148, and a withdrawn position substantially parallel to and contacting guide 148.

When beam 145 is in the open position (not shown), guide 148 and the crane (not shown) are freely accessible from the front of packing machine 1, so that the crane (not shown) can be used by the operator to assemble or disassemble parts of packing machine 1.

Figure 12:
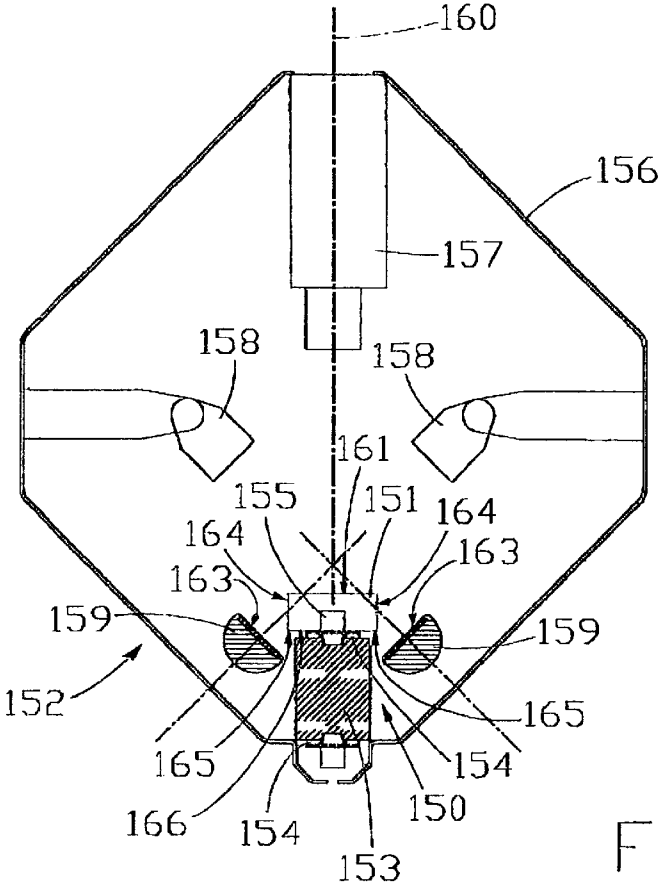
FIG. 12 shows a larger-scale front section, with parts removed for clarity, of a control station of the FIG. 1 packing machine.
Figure 13:
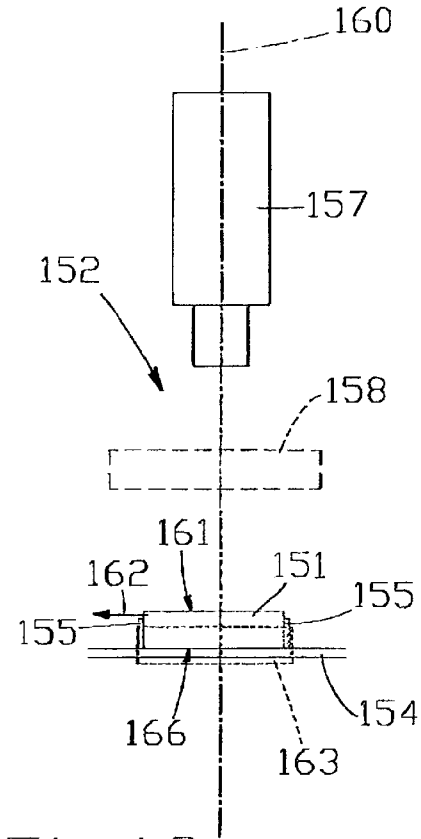
FIG. 13 shows a side view, with parts removed for clarity, of the FIG. 12 control station.

As shown in FIGS. 12 and 13, packing machine 1 has a transfer conveyor 150 (shown partly in FIG. 7), which is a horizontal belt conveyor, receives the finished packets 151 of cigarettes from vertical output conveyor 13, and feeds the finished packets 151 of cigarettes to a known follow-up cellophaning machine (not shown). A optical control station 152 is located along transfer conveyor 150 to ensure each packet 151 of cigarettes conforms with production specifications.

Transfer conveyor 150 comprises a supporting beam 153, along which runs a conveyor belt 154 with projections 155 defining seats for housing respective packets 151 of cigarettes; and control station 152 comprises a frame 156 fixed to supporting beam 153 and supporting a television camera 157, two stroboscopic lamps 158, and two mirrors 159.

Camera 157 is located over transfer conveyor 150 with its optical axis 160 perpendicular to the front wall 161 of a packet 151 of cigarettes at control station 152, and perpendicular to the feed direction 162 of transfer conveyor 150. Mirrors 159 have respective reflecting surfaces 163, which are rectangular with the major sides aligned with feed direction 162 of transfer conveyor 150, and are located on opposite sides of transfer conveyor 150 to reflect back to camera 157 a full view of the lateral walls 164 of packet 151 of cigarettes, a full view of the edges 165 between lateral walls 164 and the rear wall 166, and a view of two end portions of rear wall 166 close to edges 165 and not resting on conveyor belt 154.

In actual use, as it is fed through control station 152, each packet 151 of cigarettes is illuminated by a flash of light emitted by stroboscopic lamps 158 to enable camera 157 to pick up a single image comprising a complete view of front wall 161, a complete view of lateral walls 164, a complete view of edges 165, and a view of two end portions of rear wall 166 close to edges 165.

What is claimed is:

1. A method of producing soft packets of cigarettes comprising a substantially rectangular-prism-shaped inner packet (7), and a cup-shaped outer package (11) formed by folding a sheet (9) of packing material about the relative inner packet (7); said inner packet (7) being fed continuously along a packing path (P) extending through a supply station (22) for supplying a relative said sheet (9) of packing material; said sheet (9) of packing material being removed from said supply station (22) tangentially with respect to said packing path (P), and then being fed along said packing path (P) in a given feed direction (21) together with said inner packet (7); said inner packet (7) being fed through said supply station (22) inside a relative first conveying pocket (41); said sheet (9) of packing material being removed from said supply station (22) by feeding gripping means (49) continuously through the supply station (22), along at least a portion of said packing path (P), together with said first conveying pocket (41), in said feed direction (21); the method being characterized by imparting a reverse movement to said gripping means (49) to substantially arrest the gripping means at said supply station (22) in such a position as to interfere with said sheet (9) of packing material being fed to said supply station (22); closing said gripping means (49) on to said sheet (9) of packing material; and arresting said reverse movement.

2. The method of claim 1, wherein said sheet (9) of packing material is arrested, as it is fed to said supply station (22), by interference with said gripping means (49).

3. The method of claim 2, wherein said sheet (9) of packing material is fed to said supply station (22) in a transverse direction (54) crosswise to said packing path (P) and to said feed direction (21).

4. The method of claim 3, wherein said gripping means (49) are associated with said first conveying pocket (41), move with said first conveying pocket (41) along said packing path (P), and are located downstream from said first conveying pocket (41) in said feed direction (21).

5. The method of claim 4, wherein, downstream from said supply station (22), said sheet (9) of packing material is fed, together with the relative said inner packet (7), in an engaged position engaging the inner packet (7) and in which an intermediate portion of the sheet (9) of packing material contacts a flat lateral surface (15) of said inner packet (7), and a first end portion (26) of the sheet (9) of packing material projects rearwards, in said feed direction (21), with respect to said inner packet (7).

6. The method of claim 5, wherein, downstream from said supply station (22), said sheet (9) of packing material is smoothed on said flat lateral surface (15).

7. The method of claim 6, wherein said inner packet (7) is substantially in the form of a rectangular prism defined axially by a first and a second opposite end surface (17, 18), and defined laterally by two major lateral surfaces (15) and two minor lateral surfaces (16) parallel to a longitudinal axis (14) of the rectangular prism; said inner packet (7) being fed along said packing path (P) with said longitudinal axis (14) crosswise to said feed direction (21); said flat lateral surface (15) being a first said major lateral surface (15); and said first end portion (26) projecting rearwards of a first said minor lateral surface (16) located rearwards in said feed direction (21).

8. The method of claim 7, wherein said sheet (9) of packing material, once in said engaged position, is folded about the relative inner packet (7) by a first folding step wherein said sheet (9) of packing material is folded substantially into a U about said inner packet (7); a second folding step wherein said sheet (9) of packing material is folded further about said inner packet (7) to form, about the inner packet (7), a tubular package (25) comprising a tubular appendix (28) projecting from said second end surface (18); a gumming step wherein said tubular package (25) is stabilized; and a third folding step wherein said tubular appendix (28) is folded on to said second end surface (18) to obtain a relative finished said soft packet (12).

9. The method of claim 8, wherein, during said first folding step, the sheet (9) of packing material is folded about said inner packet (7) so that said first end portion (26) contacts part of said first minor lateral surface (16); said tubular package (25) being formed by detaching said first end portion (26) from said first minor lateral surface (16) and inserting a second end portion (27), opposite said first end portion (26), of said sheet (9) of packing material partly beneath said first end portion (26).

10. The method of claim 9, wherein said second end portion (27) is gummed along an outer surface (9*a*) before being inserted partly beneath said first end portion (26).

11. The method of claim 9, wherein said first folding step is performed by transferring said inner packet (7) and the relative sheet (9) of packing material from said first conveying pocket (41) to a second conveying pocket (74).

12. A method of producing soft packets of cigarettes comprising a substantially rectangular-prism-shaped inner packet (7), and a cup-shaped outer package (11) formed by folding a sheet (9) of packing material about the relative inner packet (7); the method being characterized in that said sheet (9) of packing material is first folded into a U about said inner packet (7) so that a first end portion (26) of the sheet of packing material contacts a minor lateral surface (16) of the inner packet (7); and is then further folded about said inner packet (7) to form a tubular package (25) by detaching said first end portion (26) from the relative said minor lateral surface (16), and inserting a second end portion (27), opposite the first end portion (26), of said sheet (9) of packing material beneath said first end portion (26).

13. The method of claim 12, wherein said second end portion (27) is gummed along an outer surface (9*a*) before being inserted partly beneath said first end portion (26).

14. The method of claim 13, wherein said outer package (11) is formed by feeding the relative inner packet (7) and relative sheet (9) of packing material along a packing path (P) in a given feed direction (21) and by means of a succession of conveying pockets (41, 74); said sheet (9) of packing material being folded into a U by transferring said inner packet (7) and the relative sheet (9) of packing material from a first said conveying pocket (41) to a second said conveying pocket (74) maintained facing each other at a transfer station (24).

15. The method of claim 14, wherein, upstream from said transfer station (24), said sheet (9) of packing material is positioned in an engaged position engaging the relative said inner packet (7) and in which an intermediate portion of the sheet (9) of packing material contacts a flat lateral surface (15) of said inner packet (7), and a first end portion (26) of the sheet (9) of packing material projects rearwards, in said feed direction (21), with respect to said inner packet (7).

16. The method of claim 15, wherein said inner packet (7) is substantially in the form of a rectangular prism defined axially by a first and a second opposite end surface (17, 18), and defined laterally by two major lateral surfaces (15) and two minor lateral surfaces (16) parallel to a longitudinal axis (14) of the inner packet (7); said inner packet (7) being fed along said packing path (P) with said longitudinal axis (14) crosswise to said feed direction (21); said flat lateral surface (15) being a first said major lateral surface (15); and said first end portion (26) projecting rearwards of a first said minor lateral surface (16) located rearwards in said feed direction (21).

17. The method of claim 16, wherein, immediately downstream from said transfer station (24), said sheet (9) of packing material has been folded into a U about the relative inner packet (7) with said first end portion (26) contacting said first minor lateral surface (16), an intermediate portion of the sheet of packing material contacting a first said major lateral surface (15) facing inwards of said second conveying pocket (74), a further intermediate portion of the sheet of packing material contacting a second said minor lateral surface (16), and an end portion projecting outwards from said second conveying pocket (74).

18. The method of claim 17, wherein said end portion is folded on to a second said major lateral surface (15), facing outwards of said second conveying pocket (74), by interference with fixed folding means (81) and so that said second end portion (27) projects rearwards of said first minor lateral surface (16); said second end portion (27) being gummed, in this position, on an outer surface (9*a*).

19. The method of claim 18, wherein said inner packet (7) is fed continuously along a packing path (P) extending through a supply station (22) for supplying a relative said sheet (9) of packing material; said sheet (9) of packing material being removed from said supply station (22) tangentially with respect to said packing path (P), and then being fed along said packing path (P) in a given feed direction (21) together with said inner packet (7).

20. The method of claim 19, wherein said sheet (9) of packing material is fed to said supply station (22) in a transverse direction (54) crosswise to said packing path (P) and to said feed direction (21).

21. The method of claim 20, wherein said inner packet (7) is fed through said supply station (22) inside a relative first conveying pocket (41) moving along said packing path (P) in said feed direction (21); said sheet (9) of packing material being removed from said supply station (22) by gripping means (49) associated with said first conveying pocket (41), moving with said first conveying pocket (41) along said packing path (P), and located downstream from said first conveying pocket (41) in said feed direction (21).

22. The method of claim 21, wherein said sheet (9) of packing material is removed from said supply station (22) by feeding said gripping means (49) continuously along said packing path (P), together with said first conveying pocket (41), in said feed direction (21); imparting a reverse movement to said gripping means (49) to substantially arrest the gripping means at said supply station (22) in such a position as to interfere with said sheet (9) of packing material being fed in said transverse direction (54); arresting said sheet (9) of packing material, as it is fed in said transverse direction (54), by interference with said gripping means (49); closing said gripping means (49) on to said sheet (9) of packing material; and arresting said reverse movement.

23. The method of claim 22, wherein, downstream from said supply station (22), said sheet (9) of packing material is fed, together with the relative said inner packet (7), in an engaged position engaging the inner packet (7) and in which an intermediate portion of the sheet (9) of packing material contacts a flat lateral surface (15) of said inner packet (7), and a first end portion (26) of the sheet (9) of packing material projects rearwards, in said feed direction (21), with respect to said inner packet (7).

24. The method of claim 23, wherein, downstream from said supply station (22), said sheet (9) of packing material is smoothed on said flat lateral surface (15).

25. The method of claim 24, wherein said inner packet (7) is substantially in the form of a rectangular prism defined axially by a first and a second opposite end surface (17, 18), and defined laterally by two major lateral surfaces (15) and two minor lateral surfaces (16) parallel to a longitudinal axis (14) of the rectangular prism; said inner packet (7) being fed along said packing path (P) with said longitudinal axis (14) crosswise to said feed direction (21); said flat lateral surface (15) being a first said major lateral surface (15); and said first end portion (26) projecting rearwards of a first said minor lateral surface (16) located rearwards in said feed direction (21).

26. A method of producing soft packets of cigarettes comprising a substantially rectangular-prism-shaped inner packet (7), and a cup-shaped outer package (11) formed by folding a sheet (9) of packing material about the relative inner packet (7); the method being characterized by said inner packet (7) being fed continuously along a packing path (P) extending through a supply station (22) for supplying a relative said sheet (9) of packing material; said sheet (9) of packing material being removed from said supply station (22) tangentially with respect to said packing path (P), and then being fed along said packing path (P) in a given feed direction (21) together with said inner packet (7);

wherein said sheet (9) of packing material is fed to said supply station (22) in a transverse direction (54) crosswise to said packing path (P) and to said feed direction (21); and wherein said inner packet (7) is fed through said supply station (22) inside a relative first conveying pocket (41) moving along said packing path (P) in said feed direction (21); said sheet (9) of packing material being removed from said supply station (22) by gripping means (49) associated with said first conveying pocket (41), moving with said first conveying pocket (41) along said packing path (P), and located downstream from said first conveying pocket (41) in said feed direction (21).

* * * * *